United States Patent [19]

Tabuchi

[11] 4,129,353

[45] Dec. 12, 1978

[54] TERMINAL BLOCK

[75] Inventor: Yasuhide Tabuchi, Nagoya, Japan

[73] Assignee: Mitsubishi Denki Kabushiki Kaisha, Nagoya, Japan

[21] Appl. No.: 843,023

[22] Filed: Oct. 17, 1977

Related U.S. Application Data

[63] Continuation of Ser. No. 728,018, Sep. 29, 1976, abandoned.

[51] Int. Cl.[2] ..... H01R 9/10

[52] U.S. Cl. ..... 339/242

[58] Field of Search ..... 339/198 R, 198 N, 242, 339/272 A

[56] References Cited

U.S. PATENT DOCUMENTS

| | | | |
|---|---|---|---|
| 2,766,436 | 9/1956 | Luebking | 339/198 R |
| 2,872,506 | 2/1959 | Flubacker | 339/198 R |
| 2,942,157 | 6/1960 | Davis | 339/198N |
| 3,007,131 | 10/1961 | Dahlgren et al. | 339/17 F |

*Primary Examiner*—Joseph H. McGlynn

*Attorney, Agent, or Firm*—Oblon, Fisher, Spivak, McClelland & Maier

[57] ABSTRACT

A terminal block for connecting terminals of an electric apparatus to a load cable which comprises a plurality of parallel auxiliary connectors, one of the two ends of the plurality of auxiliary connectors being connected to the terminals of the electric apparatus and the other of the two ends of the plurality of auxiliary connectors forming steps in a transverse direction for connection with the load cable; and an insulating base which is fixed to the auxiliary connectors to provide insulation between them and between the auxiliary connectors and the load cable, whereby the load cable can be connected to the terminals of the electric apparatus at a right angle to the terminals.

4 Claims, 5 Drawing Figures

TERMINAL BLOCK

This is a continuation of application Ser. No. 728,018, filed Sept. 29, 1976, now abandoned.

BACKGROUND OF THE INVENTION

1. Field of the Invention

The present invention relates to a terminal block for easily connecting a cable to a control unit in a control center or a unit switchboard or a unit control board.

2. Description of the Prior Art

Referring to FIG. 1, the conventional device will be illustrated. In FIG. 1, the reference numeral (1) designates a box of a control center, a unit switchboard or a unit control board; (2) designates a cable chamber which is disposed along the entire length of the box and is equipped for many control units; (3) designates a control unit which is arranged with an electric apparatus (4) such as an electromagnetic switch, a thermal relay, or a conventional terminal block at the bottom, and a load cable (6) which is lead in from the cable chamber (2), is connected to the control unit; **(4*b*) designates terminals of the electric apparatus (4); and (5)** designates partitions between control units.

In the conventional apparatus having the above-mentioned structure, the contact of the load cable (6) is not exposed in the cable chamber whereby accidents are avoided and a load cable (6) for an additional unit can be safely lead in even though the other units are under the operation.

When the cable (6) can be connected in parallel to the terminals **(4*b*) of the electric apparatus (4), in the conventional apparatus, there is no difficulty. However, when the cable (6) cannot be connected in parallel to the terminals (4*b*) because of arrangements of the electric apparatus and the cable, it is necessary to bend the end of the cable (6)** so as to be parallel to the terminals.

When the cable (6) has a large diameter in the above-mentioned structure, it is difficult to bend the cable at the lift-up end (7). Moreover, the lift-up end (7) is hard and is difficult to lead out, when the units are taken out.

SUMMARY OF THE INVENTION

It is an object of the present invention to overcome the above-mentioned disadvantages and to provide a terminal block for easily connecting a cable to terminals and easily taken out units.

The object of the present invention has been attained by providing a terminal block for connecting terminals of an electric apparatus to a load cable which comprises an auxiliary connector which is connected to terminals of the electric apparatus at one end and is stepwise arranged to connect the load cable; and an insulating base which is fixed to the auxiliary connector to insulate between phases of the connector and between the auxiliary connector and the load cable whereby the load cable can be lead in to the terminals of the electric apparatus with certain angle such as a right angle.

DETAILED DESCRIPTION OF THE PREFERRED EMBODIMENTS

Figure 1:
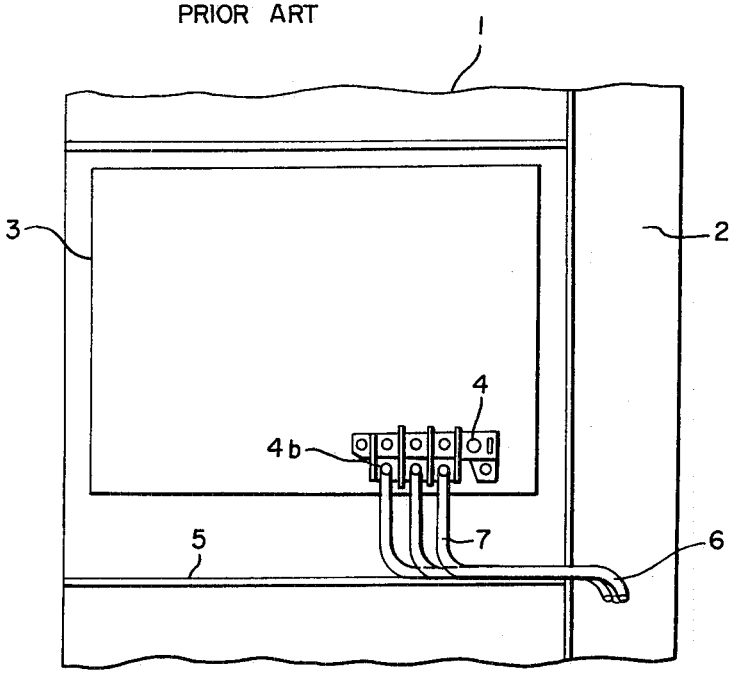
FIG. 1 PRIOR ART
FIG. 1 is a front view of a conventional control center.
Figure 2:
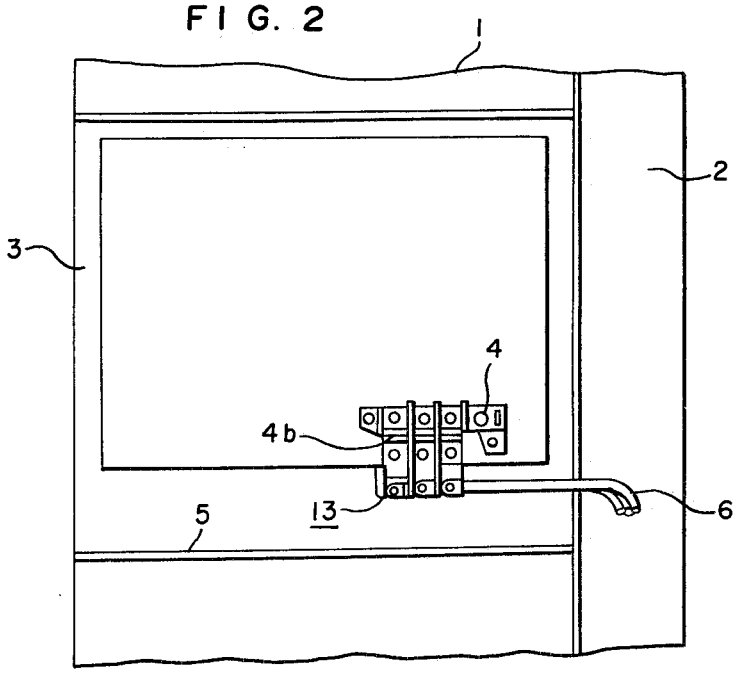
FIG. 2 is a front view of one embodiment of a control unit of the control center according to the invention.
Figure 3:
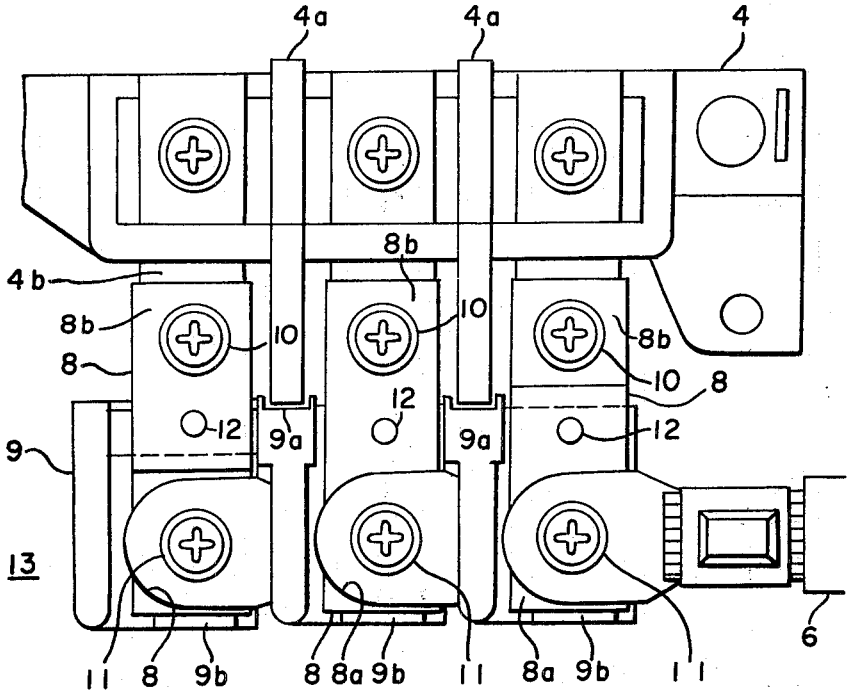
FIG. 3 is a front view of one embodiment of a terminal block according to the invention.
Figure 4:
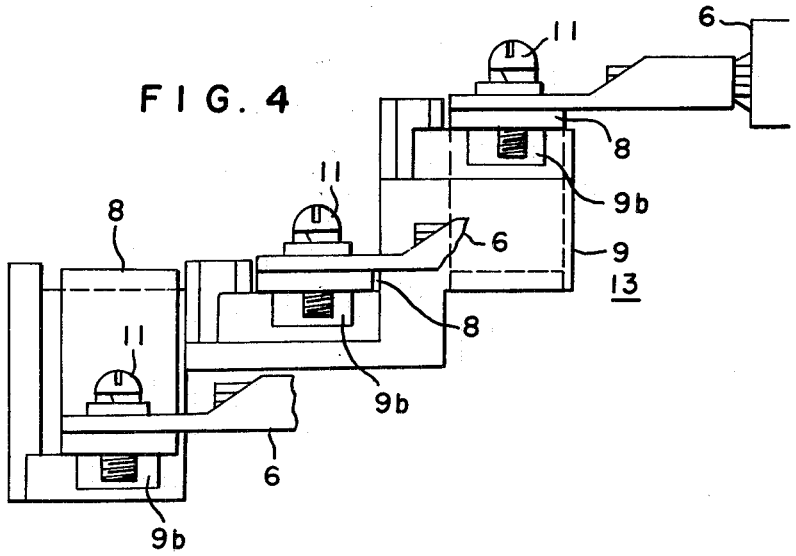
FIG. 4 is a bottom view of the terminal block.
Figure 5:
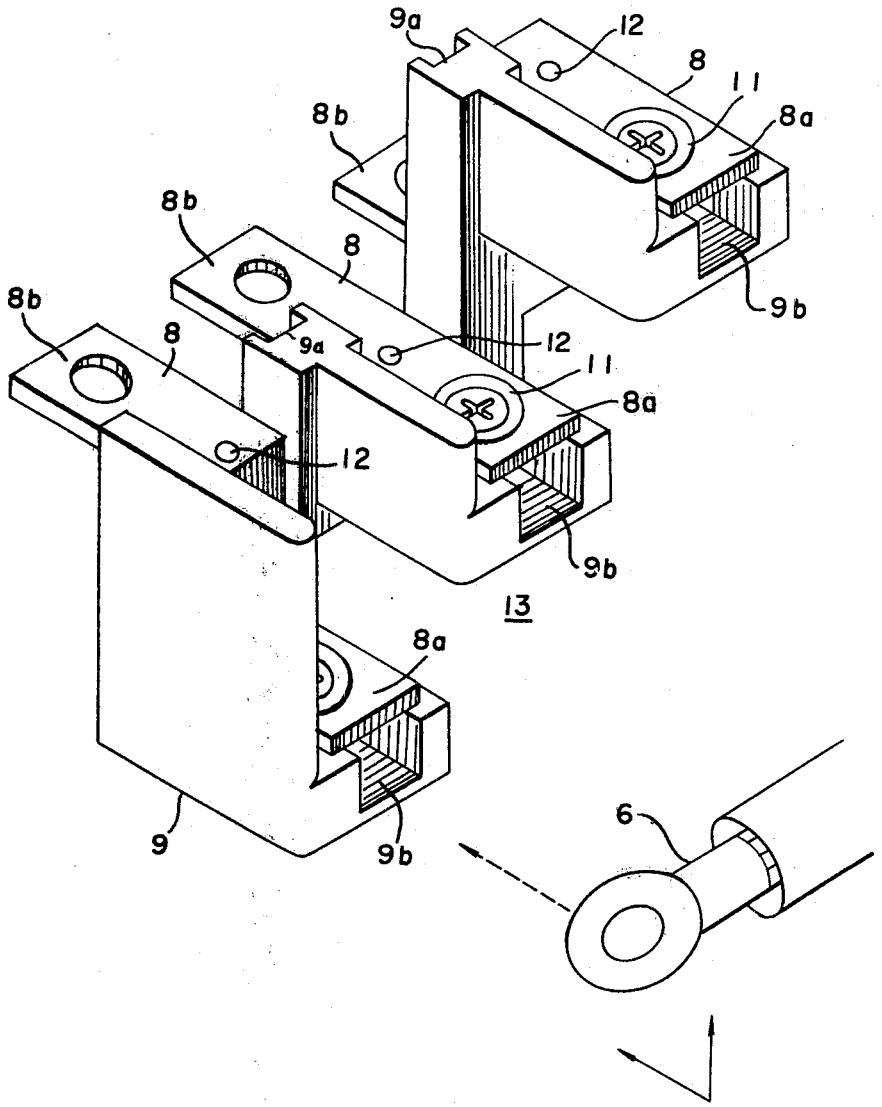
FIG. 5 is a perspective view of the terminal block.

Referring to the drawings, the embodiments of the invention will be illustrated.

In the drawings, the structures of the parts (1) to (6) are the same as those of the apparatus of FIG. 1. The box (1) of a control center, a unit switchboard or a unit control board is assembled with the cable chamber (2) which is disposed along the entire length of the box for many control units.

The control unit is arranged with an electric apparatus (4) at the bottom.

The load cable (6) is lead in from the cable chamber and is connected to the control unit. The elelctric apparatus (4) has terminals **(4*b*)and the control units are separated by partitions (5)**.

The reference numeral (13) designates a terminal block of the invention which comprises an auxiliary connector (8) for each phase and an insulating base (9). Ends **(8*b*) of the auxiliary connctors (8) are connected to the terminals of the electric apparatus (4) with a screw (10). The other ends (8*a*) of the auxiliary connectors (8) form steps in the direction of the cable chamber (2)**.

Accordingly, the end **(8*b*) of the auxiliary connector (8) for each phase is formed so as to connect to the terminals of the electric apparatus (4)** in the same plane.

Accordingly, the ends **8*a* of the auxiliary connectors 8 are formed in transverse steps. These steps are aligned in a plane perpendicular to the plane formed by ends 8*b* of the auxiliary connectors 8**.

Accordingly, the three auxiliary connectors (8) are bent corresponding to each phase (in the embodiment, the middle auxiliary connector (8) is not bent).

On the other hand, in order to provide insulation between the auxiliary connectors (8) for each phase and between the auxiliary connectors (8) and the load cable (6), a monolithic insulating base (9) is fixed to the auxiliary connectors (8) by screw (12). The groove **(9*a*) of the insulating base (9) is formed for inserting a phase barrier (4*a*) of the electric apparatus (4) in order to improve the insulation between the auxiliary connectors for each phase (8)**.

the groove **(9*b*) is a free space for the screw leg of the screw (11) for connecting the load cable (6)**.

When the terminal block (13) comprising the auxiliary connectors (8) having ends **(8*a*) forming steps for connecting the load cable and an insulating base (9) fixed to the connectors, is connected to the terminals (4*b*) of the electric apparatus, the load cable (6) which is bent in the horizontal direction in the cable chamber (2) can be connected to the terminals of the electric apparatus (4) at a right angle or some predetermined angle. Even though the load cable (6) has a large diameter, the lead in operation can be easily performed and the control units can be easily taken out by slightly shifting the load cables (6) in the horizontal direction toward the side of the cable chamber (2)**.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A terminal block for connecting the terminals of an electric apparatus to a plurality of load cables, said terminals disposed in a horizontal plane and separated by phase barriers, comprising:

a plurality of auxiliary connectors, each of said connectors having a first end for making connection with said terminals of said electric apparatus, and a second end for making connection to one of said load cables, said first ends of said connectors disposed in a common horizontal plane, said second ends of said connectors disposed in a common vertical plane perpendicular to said horizontal plane and forming transverse steps in said vertical plane; and an insulation base fixed to the auxiliary connectors to provide insulation therebetween and between said auxiliary connectors and said load cables, whereby said load cables are connected to said terminals of said electric apparatus in said vertical plane perpendicular to said horizontal plane formed by said terminals said terminal block having a cable access side from which said load cables are connected to said auxiliary connectors, the second end of said auxiliary connector adjacent said cable access side disposed vertically above all others of said second ends, with all others of said second ends disposed stepwise in said vertical plane with respect to said second end of said auxiliary connector adjacent said cable access sides;

whereby all connections of said load cables to said second ends of said auxiliary cables are unobstructed by said load cables.

2. The terminal block recited in claim 1, wherein:

said insulating base includes a plurality of grooves for inserting said phase barriers therein;

whereby said terminal block is spatially aligned with respect to said terminals of said electric apparatus.

3. The terminal block recited in claim 1, wherein:

each of said second ends of said plurality of auxiliary connectors is disposed perpendicular to said respective first end, such that each of said load cables is connected to said second end at a 90° angle relative to said respective first end.

4. The terminal block recited in claim 1, wherein:

said plurality of auxiliary connectors are molded in one piece with a molding resin to form said terminal block.

* * * * *